United States Patent [19]

Kuck

[11] Patent Number: 4,691,393

[45] Date of Patent: Sep. 8, 1987

[54] ANGULAR TILT CONTROL MECHANISM FOR A WHEELED STRETCHER

[75] Inventor: Jay L. Kuck, St. Marys, Ohio

[73] Assignee: Midmark Corporation, Versailles, Ohio

[21] Appl. No.: 855,976

[22] Filed: Apr. 25, 1986

[51] Int. Cl.[4] ..... A61G 7/00

[52] U.S. Cl. ..... 5/62; 5/60

[58] Field of Search ..... 5/62, 60, 61, 118

[56] References Cited

U.S. PATENT DOCUMENTS

| | | | |
|---|---|---|---|
| 2,217,783 | 10/1940 | Bell | 5/60 |
| 3,362,704 | 1/1968 | Pilz | 5/60 |
| 3,393,004 | 7/1968 | Williams | 5/62 |
| 3,711,876 | 1/1973 | Kirkland et al. | 5/62 |
| 3,900,906 | 8/1975 | Berthelsen | 5/62 |
| 3,905,591 | 9/1975 | Schorr et al. | 5/62 |
| 4,059,255 | 11/1977 | Perold | 5/62 |
| 4,452,439 | 6/1984 | Hogan | 5/62 |

FOREIGN PATENT DOCUMENTS

| | | | |
|---|---|---|---|
| 1616164 | 2/1971 | Fed. Rep. of Germany | 5/62 |
| 2604531 | 8/1976 | Fed. Rep. of Germany | 5/81 R |
| 2816254 | 10/1979 | Fed. Rep. of Germany | 5/81 R |
| 2256749 | 8/1975 | France | 5/81 R |

*Primary Examiner*—Gary L. Smith
*Assistant Examiner*—Carl M. DeFranco, Jr.
*Attorney, Agent, or Firm*—Biebel, French & Nauman

[57] ABSTRACT

A bed-like stretcher for supporting a patient includes a bed surface frame pivotally connected to a base. A gas spring fixes the frame in position relative to the base. A hand-operated actuator mounted to the frame is moveable in first and second opposite directions, and is biased into a normal position. A rod connects the actuator to a release rod for the gas spring, whereby movement of the actuator in either direction releases the spring to permit pivotal movement of the frame. A stop bar is secured to the frame to be adjacent an upward-facing stop surface on the base when the frame is horizontal. The bar is biased into contact with the stop surface when the frame is horizontal to prevent downward pivotal movement of the foot end. A cable connects the stop bar to the actuator, whereby movement of the actuator in one direction causes the cable to slacken and movement of the actuator in an opposite direction causes the actuator to pull the cable to withdraw the bar from contact with the stop surface.

14 Claims, 13 Drawing Figures

ANGULAR TILT CONTROL MECHANISM FOR A WHEELED STRETCHER

BACKGROUND OF THE INVENTION

The present invention relates generally to a wheeled stretcher having a bed surface and a supportive base typical of those used in hospitals. More particularly, the invention relates to means by which the bed surface of the stretcher may be moved from a flat, horizontal position to an inclined Trendelenburg or reverse Trendelenburg position.

Various types of bed-like equipment are commonly used in hospitals and other health care facilities. One type of such equipment is referred to as a stretcher, normally provided with wheels for ease of movement, and used in a variety of situations. For example, the wheeled stretcher may be used in emergency room settings, as well as in general hospital service for transporting patients from one location to another. Such a stretcher is of relatively heavy-duty construction, and includes a base supported by a plurality of wheels, the base in turn supporting the stretcher frame to which a bed portion is attached. The stretcher is also normally provided with side rails which may be selectively raised or lowered. The rails securely hold the patient on the stretcher, but can also be moved out of the way to enable the patient to move or be moved from or onto the stretcher.

Particularly when used in the emergency room, the wheeled stretcher fulfills a variety of rolls. For example, it may serve as a bed during a period of time when a patient is awaiting treatment. It can be used to transport the patient, and properly equipped, may be used as an X-ray table. Frequently, the stretcher also serves as the examination table, or even as a surgical table, for treatment of the patient.

When used as an examining table, whether in an emergency room or other setting, the stretcher may require movement from a flat, horizontal position to an inclined position. Such positions are used with some frequency in performing common medical procedures. Movement of the stretcher to a position wherein the patient's feet are raised with respect to the head is known as a Trendelenburg position. Where the patient's head is elevated with respect to the feet, the position is referred to as a reverse Trendelenburg position. In each case, movement of the stretcher to such a position requires that the bed surface remain planar, while it is piovted with respect to the stretcher base.

One known manner in which a stretcher is constructed for movement to the Trendelenburg and reverse Trendelenburg positions includes pivotally mounting the bed-supporting frame to the base. The base and frame are further connected by a gas spring. The spring includes a piston having a valve means for locking the piston into position within the spring housing. An actuation means is provided for releasing the piston for movement. Upon movement of the actuator, the spring is unlocked, and the stretcher frame may be pivotally moved by hand either upwardly or downwardly as desired. The spring provides a counterbalancing force so that the full weight of the stretcher frame is not felt by the operator in moving the frame. After release of the actuator, the gas spring locks and forms a rigid connection between the stretcher frame and base, holding the frame in its selected angled position.

The gas spring actuator is typically operated for extension or retraction by a handle located near one end of the stretcher. Pulling or pushing on this handle is then simultaneously used to move the frame into its desired angled position. However, no stop device or other indication is provided for identifying the normal, horizontal position for the stretcher. When returning the stretcher to the normal position, it may take several movements of the frame to place it into the proper position. Further, movement of the handle enables the stretcher to be moved either upwardly or downwardly, so that it is entirely possible that the stretcher may inadvertently move in a direction other than that desired. These problems are particularly significant in an emergency room setting, where the primary attention of the hospital personnel must be on the patient rather than manipulation of the stretcher.

What is needed therefore, is a control means for the angular adjust mechanism for a wheeled stretcher. The control means must enable the operator to easily find the normal position for the stretcher, as well as ensuring that the stretcher is moved in the desired direction. The control must not require complicated or cumbersome actions on the part of an operator, and should be generally similar to actions required with controls presently in use. At the same time, the control means must be relatively simple, so that it will act reliably and may be added to the stretcher assembly without unduly increasing either cost or complexity.

SUMMARY OF THE INVENTION

The present invention provides a bed-like stretcher for supporting a patient, including a frame supporting a bed surface, the frame having a length and a width and defining a head end and a foot end. A base is connected to the frame by means allowing for pivotal movement of the base along a horizontal line defined across the width of the frame.

Means is provided for fixing the frame in a pivotal position relative to the base. The fixing means may be selectively released, thereby permitting pivotal movement of the frame. A hand-operated actuator is mounted to the frame and is capable of movement in first and second opposite directions. The actuator is also biased into a normal position.

The actuator is connected to the releasing means, whereby movement of the actuator in either of the first or second directions releases the fixing means. A stop means is conneced to the frame and the base and is normally disposed in an activated position for preventing pivotal movement of the frame to move the foot end below horizontal. The stop means is also movable to a deactivated position. The stop means is connected to the actuator for movement of the stop means to the deactivated position upon movement of the actuator in the second direction.

The fixing means for the frame may include a cylinder pivotally connected between the base and the frame. The cylinder is constructed for selective extension or retraction to a desired length. Means is provided for securing the cylinder at a selected length. The cylinder may be a gas spring, with the securing means including a release rod disposed for selectively unlocking the spring upon longitudinal movement of the rod.

The release rod may be supported in a normal position for locking the gas spring, the rod being movable to an actuated position for unlocking the gas spring, and the release rod is provided with means for biasing the rod into its normal position. The release rod is disposed colinear with the cylinder and having one end near the frame. The rod is movable to its actuated position by downward longitudinal movement of the rod from the normal position.

The means for connecting the actuator and the fixing means includes means for downwardly moving the rod from the normal position in response to movement of the actuator. The deflecting means may include means defining a downward surface mounted for rotation with respect to the cylinder, and a resilient piston mounted between said downward surface and said release rod. Rotation of the surface defining means depresses the resilent piston which in turn depresses the release rod, thereby unlocking the gas spring.

The actuator may include a shaft rotatably supported across the frame at the foot end thereof, and a handle connected to the shaft such that movement of the handle causes rotation of the shaft. The means for connecting the actuator to the releasing means may then include a rod having first and second ends, the first end being pivotally connected to the shaft whereby the rod extends normally therefrom along the frame. The second end is connected to the releasing means, whereby movement of the handle in a first direction causes rotational movement of the shaft to move the rod axially in a first direction toward the foot end. Movement of the handle in a second, opposite direction causes rotational movement of the shaft to move the rod axially in a second direction away from the foot end. Either motion operates the relesing means.

The stop means may include a stop bar connected to the frame for sliding movement toward and away from the base, a spring for urging the bar toward the base, and an upward-facing catch surface defined on the base. The stop bar is connected to the frame for contact with the stop surface when the frame is disposed in a horizontal position.

The means connecting the stop means to the actuator may include a cable connected to the stop bar and the shaft, whereby movement of the handle in a first direction causes rotational movement of the shaft such that the cable slackens. Movement of the handle in a second, opposite direction then causes rotational movement of the shaft to pull the cable to withdraw the bar from contact with the stop surface and move the bar to the deactivated position.

Accordingly, it is an object of the present invention to provide a control means for the angular adjust mechanism for a wheeled stretcher that enables a stretcher attendant to easily find the normal, horizontal position for the stretcher; to provide such a control means that ensures that the stretcher is moved in the desired pivotal direction; to provide such a control means that does not require complicated or cumbersome actions on the part of an attendant, thereby requiring only minimal attention to the operation; to provide such a control means that operates using actions on the part of the attendant generally similar to those required with controls presently in use; to provide such a control means that is reliable; and to provide such a control means that may be added to the stretcher assembly without unduly increasing either cost or complexity.

Other objects and advantages of the present invention will be readily apparent from the following description, the accompanying drawings, and the appended claims.

DETAILED DESCRIPTION OF THE PREFERRED EMBODIMENT

The present invention is generally applicable to a wheeled, bed-like stretcher typically found in hospital emergency rooms and other hospital environments. The invention provides a control mechanism for movement of the bed portion of the stretcher to inclined positions wherein the head or feet of the patient is raised above the normal horizontal position. It will be recognized, however, that the present invention is also usable with other bed-like devices, including fixed examination tables, hospital beds, and the like.

Figure 1:
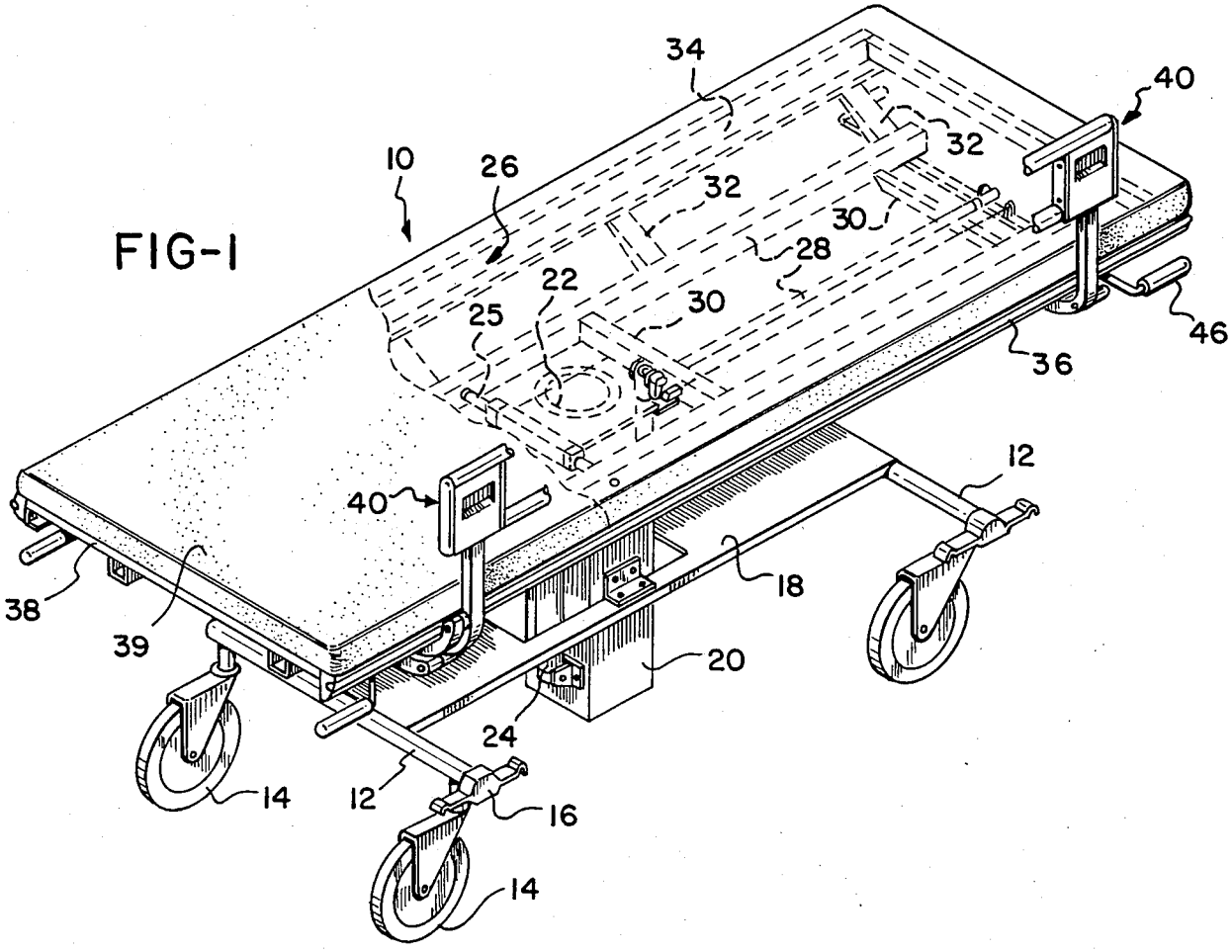
FIG. 1 is an isometric view of a stretcher incorporating the control means of the present invention, with several of the stretcher components broken away for clarity.

Referring generally to FIG. 1, a stretcher 10 is shown as having a wheeled base including supportive cross members 12. A wheel assembly 14 is provided at each end of the members 12, and a brake mechanism 16, the structure of which is well known in the art, is provided for locking the wheels to prevent movement of stretcher 10 when desired.

Cross members 12 are connected by a base plate 18, which in turn supports a hollow vertical column 20. Slidably mounted within column 20 is a primary post 22, which is connected to column 20 by a hydraulic cylinder 24. Cylinder 24 may be actuated by suitable controls such as a foot pump (not shown) to raise post 22 with respect to column 20. This provides a vertical adjustment for stretcher 10.

Primary post 22 is connected by an axle 25 to a stretcher frame 26. Frame 26 includes a pair of longitudinal frame members 28, connected by at least one lateral cross member 30. A plurality of braces 32 are secured to frame members 28 in an outward and upwardly inclined fashion. Braces 32 in turn support peripheral frame members 34, one member 34 extending along each side of frame 26. Frame members 34 are preferably formed as aluminum extrusions, and include rubber protective strips 36 attached thereto. Members 34 also support bed surface 38, upon which an appropriate mattress 39 is placed.

To prevent a patient occupying stretcher 10 from accidentally falling from the stretcher, the side rail assembly 40 is provided along each side of the stretcher. Only a single side rail is shown in FIG. 1 for purposes of clarity, with the rail shown having the central portion broken away. However, it will be understood that identical and complete side rail assemblies 40 are mounted in identical fashion to each side of the stretcher.

Figure 2:
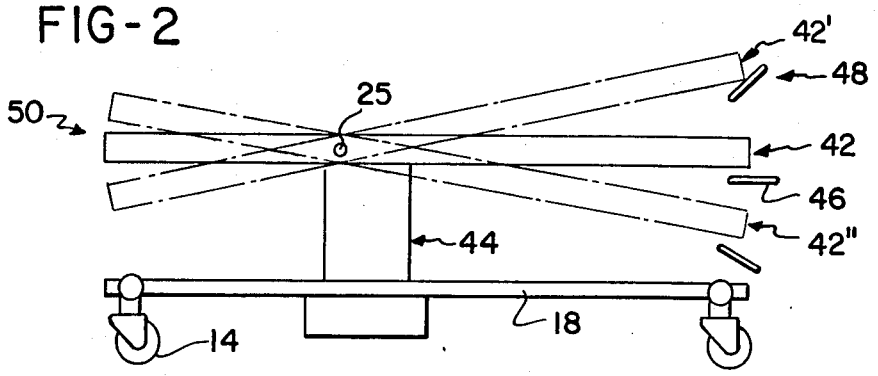
FIG. 2 is a side schematic view showing the stretcher in various angular positions.

Referring now to FIG. 2, the inclined movement of the stretcher bed 42 can be seen. Bed 42, including the stretcher frame, is pivotally mounted by axle 25 to the stretcher base 44. A pair of handles 46 (one shown in FIG. 2; see also FIG. 1) is mounted at each side of the bed near the foot end 48 of bed 42 for releasing the bed portion for pivotal movement.

Normally, bed 42 is located in a flat, horizontal position as shown in solid lines in FIG. 2. Depending upon the nature of the treatment required by the patient, the bed can be moved to the position shown by bed 42', wherein the head end 50 of the bed portion is lowered beneath the horizontal position, while the foot end 48 is raised. This position is commonly referred to as the Trendelenburg position. Alternatively, bed portion 42 may be moved to the position indicated by bed 42'', wherein the head end 50 is elevated above horizontal, while the foot end 48 is placed beneath the normal position. This position is commonly referred to as a reverse Trendelenburg position. In either case, the angle of inclination may vary depending upon particular cicumstances of the treatment required.

Figure 3:
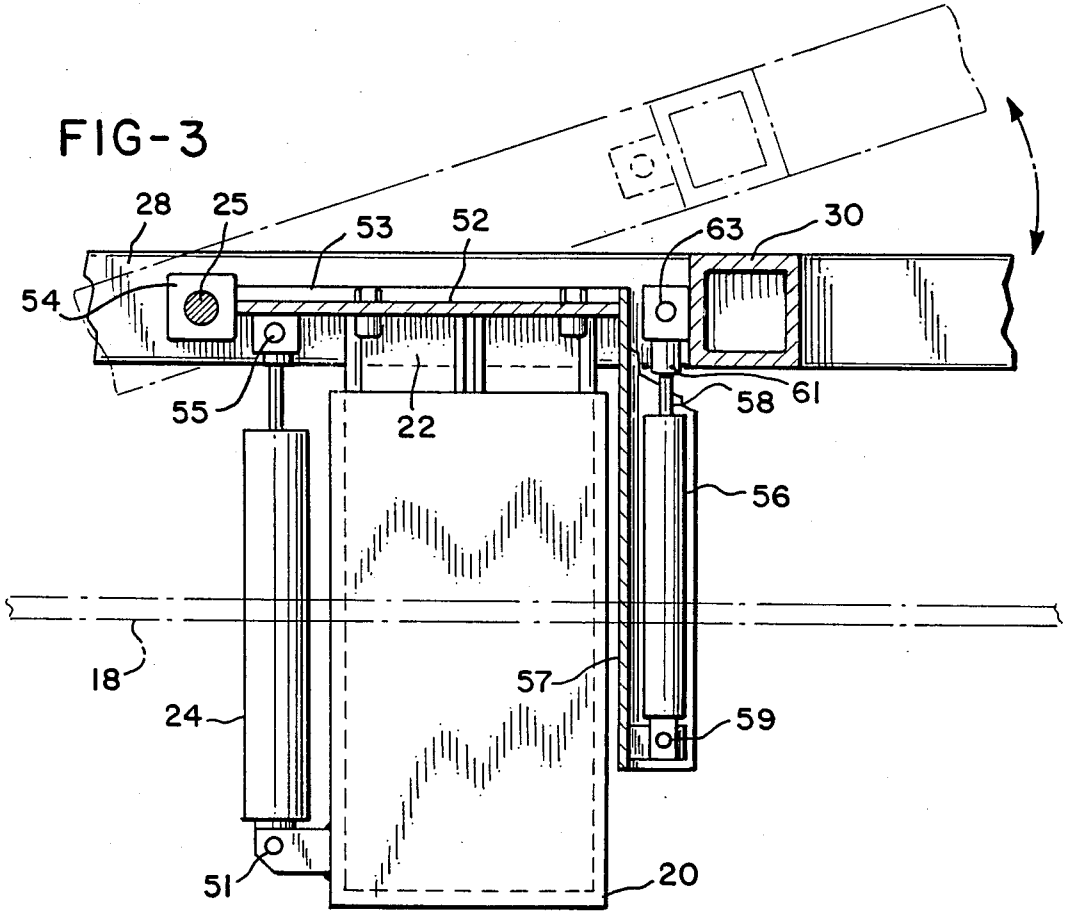
FIG. 3 is a side sectional, partially schematic view of the stretcher base and a portion of the frame, showing the connection of the gas spring for angular positioning.

The pivotal mounting for the stretcher can be seen in greater detail by reference to FIG. 3. Post 22 is shown within column 20, and is vertically movable by means of an appropriate mounting (not shown) to column 20 for vertical movement of the entire stretcher frame. The upper end of post 22 is in turn connected to a plate 52. As can also be seen by reference to FIG. 4, plate 52 includes an upwardly-extending ridge 53 for increasing the rigidity of the plate. Attached at one end of plate 52 is a block 54 having a bore defined therethrough. Shaft 25, which is in turn connected to frame members 28 (only one shown in FIG. 3), passes through this opening to provide a pivotal mount for the frame with respect to the stretcher base.

Cylinder 24 is connected to column 20 at mounting 51 located beneath base plate 18. Cylinder 24 extends upwardly to a mounting 55 on the underside of plate 52, where the cylinder is attached to the plate and, operatively, to the stretcher frame. Extension of the cylinder by an appropriate control forces plate 52 upwardly, thereby raising the entire frame.

To hold the stretcher frame in an angular position with respect to the base, a gas spring 56 is provided connecting post 22 and a cross member 30 of the stretcher frame. Other locking cylinders, such as a hydraulic cylinder could also be used to connect the stretcher frame to post 22. A spring frame 57 or partial housing extends downwardly from plate 52, with the spring 56 being pivotally connected at a mounting 59 to the lower end of the frame 57.

Gas spring 56 may be any appropriate commercially available gas spring, such as those available from Gas Spring Corporation of Colmar, Pa. The spring includes a piston (not shown) connected to a release rod 58. Secured to the upper end of rod 58 is an actuator tube 61 pivotally connected at mounting 63 to cross member 30 of the stretcher frame.

Figure 5:
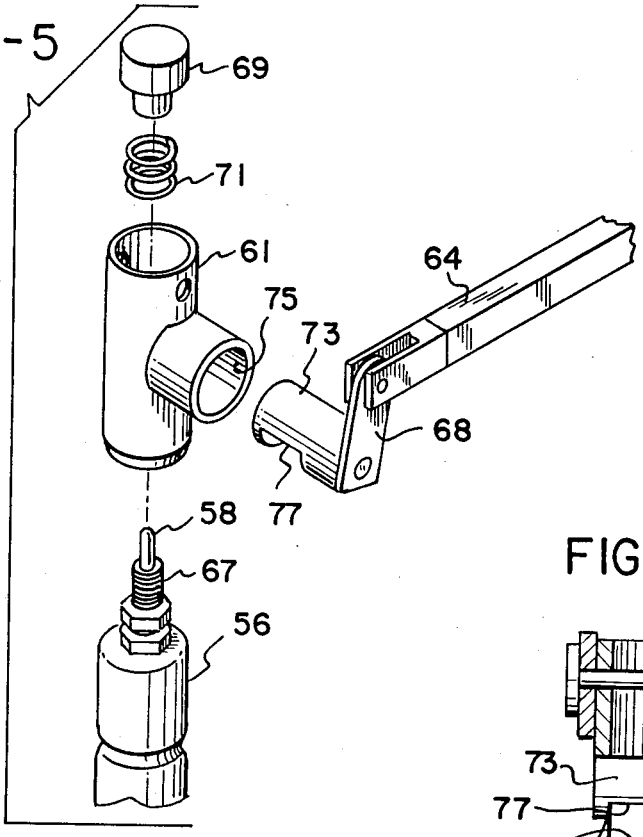
FIG. 5 is a three-quarter exploded view of an upper portion of the gas spring and the mechanism for releasing the spring for movement.

Within gas spring 56, a piston is provided with a fluid passage extending therethrough and a valve for selectively closing and opening the passage. Fluid is contained on each side of the piston. Referring now to FIG. 5, downward movement of release rod 58 opens the valve, permitting fluid flow from one side of the piston to the other. The fluid flow counterbalances the weight of the stretcher frame during angular movement of the frame.

Figure 6:
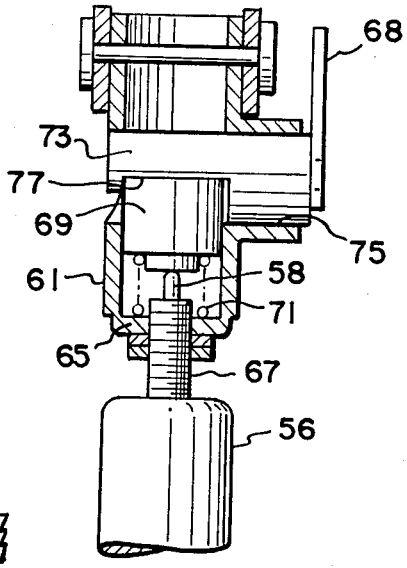
FIG. 6 is a side sectional view of the gas spring and mechanism of FIG. 5, showing the mechanism in assembled form.

The actuating mechanism for downward movement of release rod 58 may be seen by reference to FIGS. 5 and 6. Actuator tube 61 is closed at its lower end by an end wall 65 provided with a threaded opening. A hollow threaded tube 67 extends upwardly from gas spring 56, with the tube and threaded opening being engaged to connect the spring to acutuator tube 61. Release rod 58 extends through tube 67 and into tube 61. A spring 71 is positioned on end wall 65, surrounding the upperportion of rod 58. A resilient piston 69, having a diameter only slightly less than the inner diameter of tube 61, is positioned on top of spring 71, with the lowermost surface of resilient piston 69 in contact with the uppermost end of rod 58.

An actuating cylinder 73 is positioned laterally through tube 61, with one end of cylinder 73 protruding through a side opening 75 in tube 61. A cut-out portion 77 is provided on a surface of cylinder 73 to be located downwarly within tube 61. As shown in FIG. 6, portion 77 is located against resilient piston 69.

Referring back to FIG. 4, movement of release rod 58 is initiated by an operator through pivotal movement of one of the two handles 46 mounted at the outer ends of a shaft 62 mounted for rotation to frame members 28. An actuating rod 64 is connected by a pivotal link 66 to shaft 62. Actuator rod 64 extends along a substantial portion of the length of the stretcher frame, and passes through an opening defined in frame cross member 30. Actuator rod 64 is then pivotally connected to a crank 68.

Referring to FIG. 7 and again to FIG. 5, crank 68, pivotally connected to actuator rod 64, is fixedly connected to actuator cylinder 73 at the end thereof extending from opening 75 in tube 61.

Figure 4:
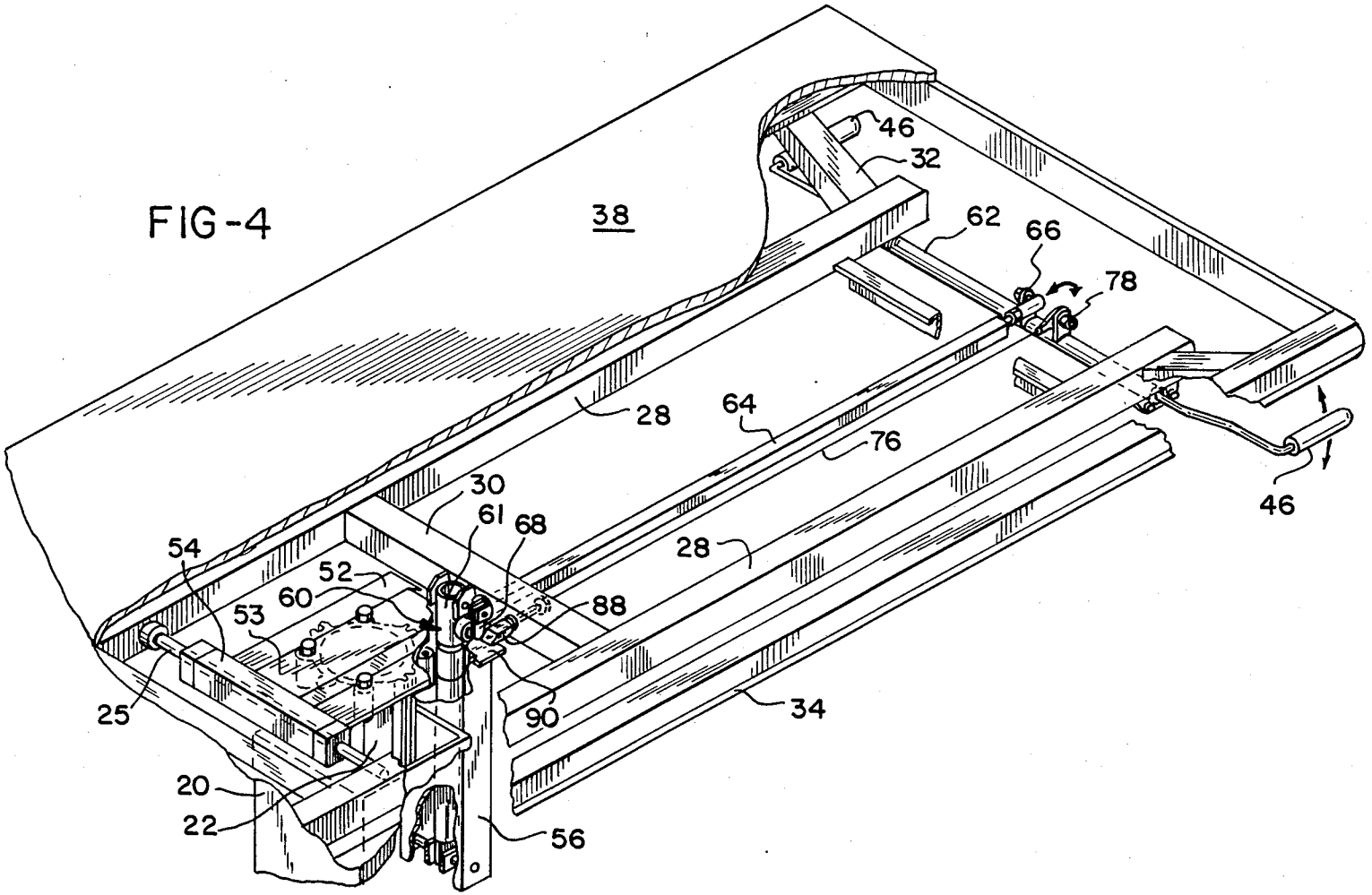
FIG. 4 is an enlarged isometric view of a portion of FIG. 1, showing the control means in further detail.
Figure 7:
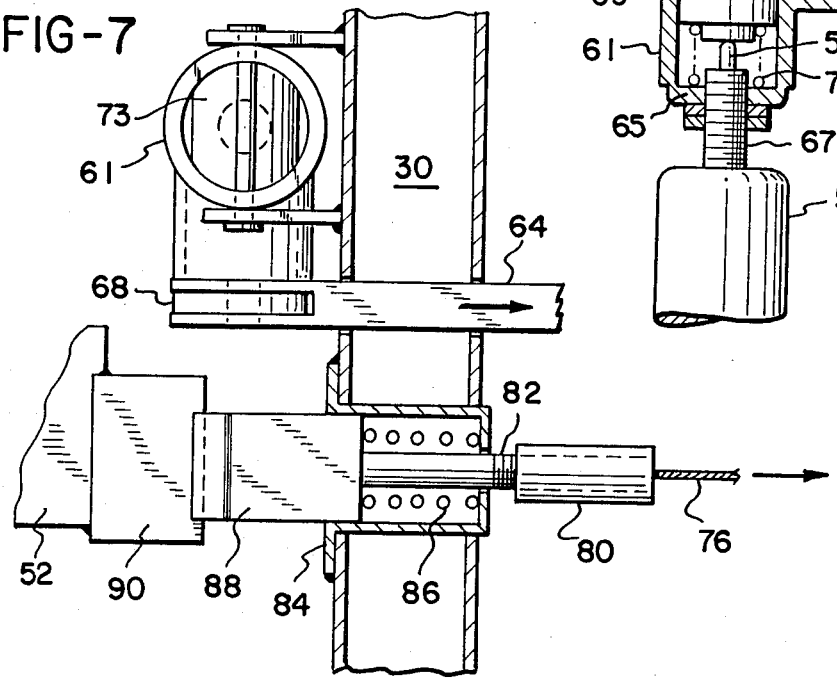
FIG. 7 is a top sectional view of a portion of the control means shown, in FIG. 4.

Also attached to shaft 62 is a cable 76, shown in FIG. 4, attached at a pivotal mounting 78. As seen in FIG. 7, cable 76 includes at its opposite end a cable nut 80 which attaches to a threaded shaft 82 protruding through a cylindrical bushing 84 secured within frame cross member 30.

Disposed about threaded shaft 82 within bushing 84 is a coil spring 86. Secured to the end of shaft 82, holding spring 86 in position, is a latch bar 88 slidable within bushing 84. As also seen in FIG. 4, latch bar 88 includes a beveled leading edge and cooperates with a catch surface 90 defined as a portion of plate 52.

Figure 8:
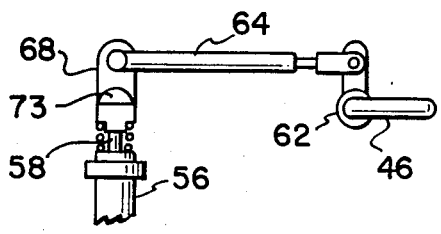
FIGS. 8 and 9 are side schematic views of the control means for releasing the cylinder valve and for withdrawing the stop means, respectively, shown with the actuating handle in its normal position.
Figure 9:
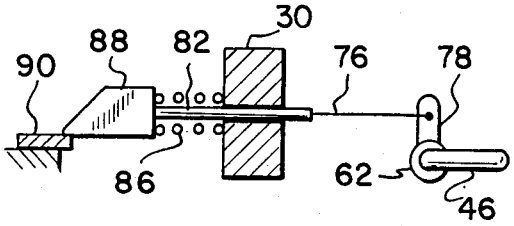

The operation of the control mechanism for pivotal movement of the stretcher frame with respect to the stretcher base can be seen by reference to FIGS. 8–13. In FIGS. 8 and 9, handle 46 is shown in its normal position. In FIG. 8, actuator rod 64 can be seen connecting shaft 62 with crank 68, which is in turn connected to cylinder 73. Rod 58 extends upwardly from gas spring 56, with the spring locked into position. Resilient piston 69 is urged upwardly into contact with the lower surface of the cut-away portion of the cylinder 73.

In FIG. 9, it can be seen that at the same time, i.e., when handle 46 is in its normal position, cable 76 interconnects shaft 62 with the end of threaded shaft 82. Spring 86 is essentially uncompressed at such time, and urges or holds latch bar 88 away from frame member 30 in a normal position. In such position, provided the stretcher frame is in its horizontal position, latch bar 88 is in contact with catch surface 90 which is fixed with respect to the stretcher base (see FIGS. 3 and 4).

Figure 10:
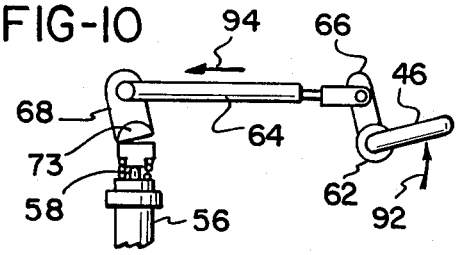
FIGS. 10 and 11 are views similar to FIGS. 8 and 9, respectively, shown with the handle in position for upward movement of the foot end of the stretcher frame.

Referring now to FIG. 10, in the event an attendant wishes to move the stretcher frame into the Trendelenburg position, i.e., with the foot end of the stretcher raised (see FIG. 2), handle 46 is pivoted upwardly as indicated by arrow 92. Resultant rotational movement of shaft 62 causes actuator rod 64 to be advanced in the direction indicated by arrow 94. This in turn rotates crank 68 along with cylinder 73. The rotational movement of cylinder 73 depresses resilient piston 69 against rod 58 and compresses spring 71. Rod 58 then opens the valve contained within the gas spring to release the spring for movement. Thus, the attendant, by continued upward pulling on handle 46, can move the stretcher frame into the desired Trendelenburg position. (It should be noted that during such pivotal movement of the stretcher frame, all portions shown in FIG. 10 will be pivotally moved upwardly along with the frame.)

When the desired angular position is reached, handle 46 is released. This returns handle 46 and cylinder 73, along with all associated moving parts, to the position shown in FIG. 8. Since fluid flow within gas spring 56 is now precluded, spring 56 is fixed in its present position.

Figure 11:
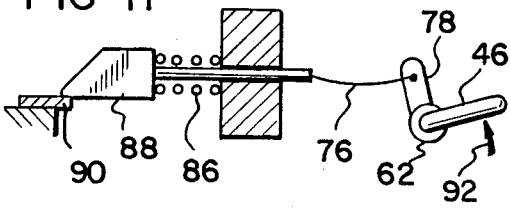

Referring now to FIG. 11, when handle 46 is raised to move the stretcher to the Trendelenburg position, a pivotal motion of connector 78 occurs similar to that of connection 66. As shown in FIG. 11, however, such movement simply causes cable 76 to slacken, and latch bar 88 remains firmly in contact with catch plate 90. All components shown in FIG. 11 move with the stretcher frame as it is pivotally moving upward, with the exception of catch plate 90 which is fixed with respect to the stretcher base. Thus, movement of the frame to the Trendelenburg position causes latch bar 88 to lift upwardly from catch plate 90.

It should be noted that movement of handle 46 and unlocking of gas spring 56 as shown in FIG. 10 does not require that pivotal movement of the foot end of the stretcher frame be upward. However, since latch bar 88 remains in contact with catch surface 90, no downward movement of the foot end of the frame can be carried out. Thus, upward movement of handle 46 will not result in unwanted downward movement of the stretcher frame.

Further, should the stretcher be located in the Trendelenburg position, it can be accurately returned to the horizontal position by lifting of handle 46 upwardly as shown in FIGS. 10 and 11. Release rod 58 is depressed to unlock and permit contraction of gas spring 56 during downward movement of the foot end of the stretcher frame. However, since latch bar 88 remains in its extended position, it will contact catch surface 90 when the stretcher frame returns to horizontal, thereby preventing further downward movement.

Figure 12:
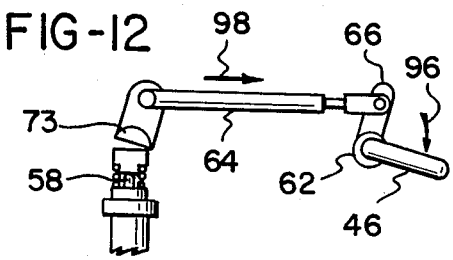
FIGS. 12 and 13 are views similar to FIGS. 8 and 9, respectively, shown with the handle in position for downward movement of the foot end of the stretcher frame.

In the event the attendant wishes to lower the foot end of the stretcher frame, to move the stretcher frame to the reverse Trendelenburg position, handle 46 is pivotally moved downwardly, as shown by arrow 96 in FIG. 12. Resulting rotational movement of shaft 62 and pivotal movement of connector 66 causes actuator rod 64 to be pulled in the direction indicated by arrow 98. This in turn causes rotational movement of cylinder 73 to cause piston 69 to depress rod 58 so as to unlock gas spring 56 in a manner similar to movement of handle 64 in an upward direction.

Figure 13:
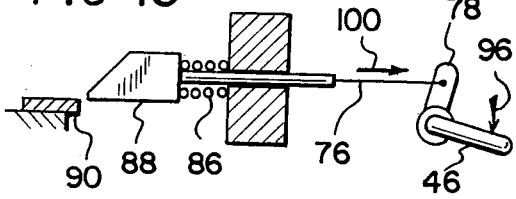

At the same time, as shown in FIG. 13, the downward movement of handle 46 causes a similar pivotal movement of connector 78. This in turn pulls cable 76 as shown by arrow 100. The pulling force is applied, through threaded rod 82, to latch bar 88. Bar 88 is thus pulled away from catch surface 90, at the same time compressing spring 86. Once bar 88 has been withdrawn to clear surface 90, downward movement of the foot end of the stretcher frame can be carried out by continued downward pushing force applied to handle 46. When handle 46 is released, spring 86 returns latch bar 88 to its normal outwardly-extending position.

To return the stretcher frame from the reverse Trendelenburg position to the horizontal position, handle 46 is again pivoted upwardly as shown in FIGS. 10 and 11. With gas spring 56 unlocked, the frame may be moved upwardly by pulling on handle 46. As latch bar 88 approaches catch surface 90, the beveled surface of bar 88 contacts the leading edge of surface 90. Further upward movement then forces bar 88 away from surface 90, compressing spring 86. As soon a bar 88 clears surface 90, spring 86 returns bar 88 to its outwardly extending position. A slight downward movement on the stretcher frame brings bar 88 firmly into contact with surface 90, placing the stretcher frame in the horizontal position. Release of handle 46 returns the portions to the normal positions shown in FIGS. 8 and 9.

Of course, it will be recognized that upward movement can also be carried out by moving handle 46 downwardly, thereby depressing release rod 58. However, because bar 88 is withdrawn through such handle movement, no stop is provided for placing the stretcher frame accurately into the horizontal position.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A bed-like stretcher for supporting a patient, comprising:

a frame for supporting a bed surface having a length and a width and defining a head end and a foot end;

a base;

a shaft connecting said frame to said base for pivotal movement of said frame along a horizontal line defined across said width of said frame;

fixing means for fixing said frame in any selected pivotal position within an available range relative to said base;

a release rod connected to said gas spring for selectively releasing said gas springs, thereby permitting pivotal movement of said frame;

a hand-operated actuator mounted to said frame capable of movement in first and second opposite directions to, respectively, first and second positions;

means for biasing said actuator into a normal position intermediate of said first and second positions;

a second rod connecting said actuator to said release rod whereby movement of said actuator in either of said first or second directions releases said gas spring to permit pivotal movement of said frame;

an upward-facing stop surface defined on said base;

a stop bar secured to said frame so as to be adjacent said stop surface when said frame is in a horizontal position;

a spring biasing said bar into contact with said stop surface when said frame is in said horizontal position to prevent downward pivotal movement of said foot end while having no effect on pivotal movement of said head end below horizontal;

a cable connecting said stop bar to said actuator, whereby movement of said actuator in a first direction causes said cable to slacken and movement of said actuator in a second direction causes said actuator to pull said cable to withdraw said bar from contact with said stop surface, thereby permitting pivotal movement of said foot end below horizontal.

2. A stretcher as defined in claim 1, wherein said fixing means includes a cylinder pivotally connected between said base and said frame, said cylinder being constructed for selective extension or retraction to a desired length, and securing means for securing said cylinder at a selected length.

3. A stretcher as defined in claim 2, wherein said cylinder is a gas spring including a housing and said release rod extends from said housing for controlling said securing means.

4. A stretcher as defined in claim 3, wherein said release rod is biased into a normal position wherein said gas spring is fixed at a selected length, and wherein movement of said release rod inwardly with respect to said housing unlocks said gas spring for selective extension or retraction.

5. A stretcher as defined in claim 4, wherein a portion of said release rod extending from said housing is disposed along near said frame, said release rod being colinear with said gas spring, said release rod being movable inward with respect to said housing to unlock said gas spring by downward movement of said rod with respect to said frame.

6. A stretcher as defined in claim 5, wherein said release rod includes means for translating rotational movement to downward movement with respect to said frame, said translating means being connected to said actuator for rotational movement thereby.

7. A stretcher as defined in claim 1, wherein said actuator includes a shaft rotatably supported across said frame at said foot end thereof, and a handle connected to said shaft whereby movement of said handle causes rotation of said shaft.

8. A stretcher as defined in claim 7, wherein said second rod comprises first and second ends, said first end being pivotally connected to said shaft whereby said rod extends normally therefrom along said frame, said second end being connected to said releasing means, whereby movement of said handle in a first direction causes rotational movement of said shaft to move said rod axially in a first direction toward said foot end, and movement of said handle in a second, opposite direction causes rotational movement of said shaft to move said rod axially in a second direction away from said foot end.

9. A stretcher as defined in claim 8, wherein said stop bar is connected to said frame for sliding movement toward and away from said base, a spring for urging said bar toward said base, and an upward-facing catch surface defined on said base, said stop bar being connected to said frame for contact with said stop surface when said frame is disposed in a horizontal position.

10. A stretcher as defined in claim 9, wherein said cable is connected to said stop bar and said shaft, whereby movement of said handle in a first direction causes rotational movement of said shaft such that said cable slackens, and movement of said handle in a second, opposite direction causes rotational movement of said shaft to pull said cable to withdraw said bar from contact with said stop surface and move said bar to said deactivated position.

11. A stretcher as defined in claim 1, wherein said second rod comprises first and second ends, said first end being disposed generally at said foot end of said frame, said rod extending normally therefrom along said frame, said second end being connected to said releasing means, whereby movement of said rod in either a first or second axial direction causes said releasing means to release said fixing means.

12. A stretcher as defined in claim 11, wherein said stop bar is connected to said frame for sliding movement toward and away from said base, a spring for urging said bar toward said base, and an upward-facing catch surface defined on said base, said stop bar being connected to said frame for contact with said stop surface when said frame is disposed in a horizontal position.

13. A stretcher as defined in claim 12, wherein said cable is connected to said stop bar and extending toward said foot end of said frame, whereby pulling movement of said cable toward said foot end causes rotational movement of said shaft to pull said cable to withdraw said bar from contact with said stop surface and move said bar to said deactivated position.

14. A stretcher as defined in claim 13, wherein said actuator includes a shaft rotatably supported across said frame at said foot end thereof, and a handle connected to said shaft whereby movement of said handle causes rotation of said shaft, said shaft further being connected to said rod and said cable, rotation of said shaft in a first rotational direction causing axial movement of said rod in said first axial direction and causing said cable to slacken, and rotation of said shaft in a second, opposite rotational direction causing axial movement of said rod in said second axial direction and causing pulling movement of said cable.

* * * * *